US007274289B2

(12) United States Patent
Kerr et al.

(10) Patent No.: US 7,274,289 B2
(45) Date of Patent: Sep. 25, 2007

(54) SYSTEM AND DEVICE FOR DETECTING OBJECT TAMPERING

(75) Inventors: Roger S. Kerr, Brockport, NY (US); Timothy J. Tredwell, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 409 days.

(21) Appl. No.: 10/854,880

(22) Filed: May 27, 2004

(65) Prior Publication Data

US 2005/0275537 A1 Dec. 15, 2005

(51) Int. Cl.
*G08B 23/00* (2006.01)

(52) U.S. Cl. ..... 340/500; 340/572.1

(58) Field of Classification Search ..... 340/500, 340/572.1, 540, 541, 652, 568.2
See application file for complete search history.

(56) References Cited

U.S. PATENT DOCUMENTS

| | | | | |
|---|---|---|---|---|
| 4,234,875 | A * | 11/1980 | Williams | 340/550 |
| 4,593,384 | A * | 6/1986 | Kleijne | 365/228 |
| 5,117,222 | A | 5/1992 | McCurdy et al. | |
| 5,506,566 | A * | 4/1996 | Oldfield et al. | 340/550 |
| 5,675,319 | A * | 10/1997 | Rivenberg et al. | 340/550 |
| 5,831,531 | A * | 11/1998 | Tuttle | 340/568.2 |
| 5,884,425 | A | 3/1999 | Baldwin | |
| 6,069,563 | A | 5/2000 | Kadner et al. | |
| 6,104,295 | A | 8/2000 | Gaisser et al. | |
| 6,346,886 | B1 | 2/2002 | De La Huerga | |
| 6,420,971 | B1 | 7/2002 | Leck et al. | |
| 6,501,390 | B1 | 12/2002 | Chainer et al. | |
| 6,535,129 | B1 | 3/2003 | Petrick | |
| 6,895,509 | B1 * | 5/2005 | Clark | 726/23 |
| 6,995,669 | B2 * | 2/2006 | Morales | 340/539.31 |

FOREIGN PATENT DOCUMENTS

| | | |
|---|---|---|
| EP | 0 698 562 A1 | 2/1996 |
| EP | 1 020 813 A2 | 7/2000 |
| EP | 1 126 358 A1 | 8/2001 |
| WO | WO93/23648 | 11/1993 |

OTHER PUBLICATIONS

Michael Wolfe et al., "Electronic Cargo Seals: Context, Technologies and Marketplace", prepared for Intelligent Systems Joint Program Office, Federal Highway Administration, U.S. Department of Transportation, Jul. 2002, pp. 1-46.

* cited by examiner

*Primary Examiner*—Phung T. Nguyen

(57) ABSTRACT

Systems and devices are provided for detecting access to an object. A pattern of conductors extending in spaced, isolated configuration is provided on the object defining a tamper detection area. At least one sensor device is connected to the pattern of conductors and is capable of detecting a change in the continuity of the pattern of conductors. A communication circuit provides at least one signal indicative of the change in continuity of the pattern of conductors. The tamper detection area of conductors confronts each surface of the object.

70 Claims, 4 Drawing Sheets

SYSTEM AND DEVICE FOR DETECTING OBJECT TAMPERING

FIELD OF THE INVENTION

The present invention relates to systems used for the monitoring and protection of objects including but not limited to shipping containers such as truck trailers, railroad container cars, and airline shipping boxes.

BACKGROUND OF THE INVENTION

Cargo theft and intentional damage to cargo carried on rail, shipping and air lines is steadily on the rise with cargo industry estimates of loss from cargo in transit and storage surpassing the $30-$50 billion per year. In order to protect cargo in transit or storage, it is known to provide cargo seals on the entrance of cargo containers as part of good security practice. The principal purpose of a cargo seal is to assure carriers, beneficial owners of cargo, and government officials that the integrity of a shipment is intact by acting as a 'tell-tale' indicator that a cargo container has or has not been tampered with. There are two major categories of cargo container seals, i.e., indicative and barrier seals, both of which detect tampering or entry.

Indicative seals are usually made of plastic, wire, or strips of sheet metal marked with a unique serial number or identifier. These seals may be looped through a hasp or around locking bars and handles so that the container or trailer door cannot be opened without removing the seal. Indicative seals offer no physical protection, they simply reflect whether or not the sealed entrance has been compromised. They may be used together with locks or alone.

Barrier seals add physical protection to tamper detection and are more difficult to defeat. It usually takes bolt cutters or special tools to remove a barrier seal, not simple wire cutters or a sharp knife. Barrier seals take many forms, with the simplest using steel cable rather than wire. Bolt seals are generally more protective, using heavy-duty bolts with specialized single-use locking nuts and unique identifiers.

Barrier seals vary widely in the degree of protection they offer. Many factors affect protection, including the design, materials, and construction of the locking device, and the design and materials in the hasp, bolt, or cable. However, the typically robust appearance of such seals does not guarantee great protection as they can be defeated by experienced and determined criminals. Further, the trade abounds with tales of popular barrier seal designs that have been copied with inferior materials.

Electronic seals can simply mirror the traditional indicative and barrier seals in terms of protection. Some approaches use electronics as intrusion sensors or indicative seals. It is also common to find electronic devices married to traditional barrier seal components such as steel bolts and cables.

More sophisticated and expensive approaches use electronics to control the operation of locks and seals. One approach programs a latitude/longitude location or key code into the seal, which will not open until an internal or external device confirms the correct location or code. Another approach enables remote control of the locking mechanism via satellite or radio frequency (RF) messages.

Still another approach uses electronic seals that have sensors equipped with radio frequency transponders that generate radio frequency signals that indicate that a mechanical door seal has been tampered with. In some cases, the transponders provide self-identifying signals.

Radio frequency transponders of this latter type are commonly known as Radio Frequency Identification (RFID) tags. There are two main types of RFID tags, passive and active. Passive tags do not initiate transmissions, i.e., they respond when activated by the energy in the signal from a reader. Interrogated by a reader, a passive tag can identify itself by reporting its identification number, analogous to a standard bar code. The passive tag can also perform processes, such as testing the integrity of a seal. One advantage of a battery-free passive seal is that it can be a simple, inexpensive, and disposable device. Although not a formal term, it is useful to think of such devices as purely "passive" a term that describes what most have in mind when they discuss passive RFID electronic seals.

However, passive RFID seals can carry batteries for either or both of two purposes. The first is to aid communication by boosting the strength of the reflective signal back to the reader. The second purpose is to provide power so functions can be performed out of the range of readers. One example of the latter is to power a clock, so that the integrity of the seal can be periodically tested and, when the integrity is compromised, a record can be made indicating the time that the seal was tampered with. Adding substantial capability, however, could raise the cost of a passive seal sufficiently that it would be practical only as a reusable product.

Conventionally, users employ three different terms to describe passive tags with batteries. They are semi-active, semi-passive, and battery-assisted passive. Since the terms appear to be used in the art in an interchangeable manner, this is a source of confusion in RFID tag discussions. Some manufacturers have used the term semi-passive, but are now transitioning to the term battery-assisted passive to reduce customer confusion.

Besides the battery-assisted passive RFID tag, all other known passive electronic seals are "pure passive," with no battery whatsoever. Pure passive functionality is limited to testing the integrity of the seal when interrogated by a reader and reporting that status, its ID, and other on-board information to the reader. Further, manual seal manufacturers often use batteries on passive tags, preferring instead, if forced to use a battery in the tag doing so in the context of an active seal.

Passive seals tend to be short range and directional to maximize antenna exposure to reader signal strength. Maximum read range for electronic seals without battery-assisted communications tends to be two or three meters, with some debate about efficacy beyond two meters. Adding a battery can boost the range, i.e., design target is greater than 30 meters, but concerns about safety, regulations, and the operating environment impose practical limits on power and range.

Active seals can initiate transmissions as well as respond to interrogation. All active tags and seals require on-board power, which generally has meant providing the tag with some sort of a battery.

A major attraction of active tags and seals is the potential for longer-range and omni-directional communications, i.e., up to 100 meters. Customers expressed need for greater range and the ability of signals to wrap around obstructions in terminal operating environments prompted an international standards group working on electronic seal and read/write container RFID standards to add active RFID protocol (s).

At the lowest functionality, active seals typically cost more than pure passive seals because of the battery and the ability to initiate communications, but the difference would be relatively small. Actual price differences between passive and active RFID seals in the marketplace tend to be much larger, reflecting design choices to host greater functionality on active tags, i.e., taking advantage of the battery, the potential to initiate communications, and the greater, more flexible range.

All active RFID electronic seals in or approaching commercial use monitor seal integrity on a near-continuous basis, and most capture the time of tampering and write it to an on-board log. Examples of such seals are shown in U.S. Pat. No. 5,831,531 (Tuttle), U.S. Pat. No. 6,501,390 (Chainer et al), U.S. Pat. No. 6,069,563 (Kadner et al) and U.S. Pat. No. 5,117,222 (McCurdy et al) each of which are hereby incorporated by reference and are directed to an RF tag provided with a battery for detecting and actively (or passively) reporting to a unit, e.g., interrogator attached to a host computer. Some RFID seals can accept GPS and sensor inputs, and some can provide live "mayday" tampering reports as the events happen, mostly within specially equipped terminals.

There are trade-offs between these technologies from theoretical and practical perspectives. Theoretically, the only difference between passive and active tags and seals is the ability to initiate communications from the tag—a distinction that means, for example, that passive RFID tags could not initiate mayday calls or generate routine self-initiated status signals.

However, there is an unmistakable clustering in the marketplace, in which an overwhelming number of manufacturers choose cost and simplicity, i.e., passive RFID-based seal designs which are battery-free.

The types of cargo seals described above are placed on the entrance to a cargo container and as a result many thieves simply avoid these conventional cargo seals by simply cutting through a roof, side wall or bottom of a cargo container to avoid the seal altogether. There is a distinctive need for a low cost, easy to install cargo seal which is reliable and cannot be defeated by simply avoiding the seal altogether.

All of the above are used for protection or detection of tampering at the entrance, door or opening of a container and do not address tampering of the sides of a container.

SUMMARY OF THE INVENTION

The invention relates to systems and devices for detecting product tampering.

One detection device of the invention, for use with an object having surfaces, can include a substrate including pattern of conductors extending in spaced, isolated configuration on the substrate to define a detection area upon the substrate. The detection device has at least one sensor device connected to the pattern of conductors, which is capable of detecting a change in continuity of at least one of the conductors. The at least one sensor detects a change in continuity of the pattern of conductors providing a signal indicative of a change in the continuity of any of the conductors. For example, this change could be determined by the sensor detecting a change in continuity of at least one of the conductors, which occurred during a time of storage or transport of the object from one location to another location, from a baseline of expected continuity when the conductors were unaltered or unbroken. The tamper detection area of the pattern of conductors is of sufficient dimensional configuration to enable positioning in close proximity to the object so as to confront each surface of the object.

Another embodiment of the invention includes a tamper detection system for use with an object having surfaces. The tamper detection system includes a substrate including a pattern of conductors extending in closely spaced, isolated configuration on the substrate to define a tamper detection area upon the substrate. At least one sensor device is connected to the pattern of conductors, which is capable of detecting a change in the continuity of the pattern of conductors and having a radio frequency circuit providing at least one radio frequency signal indicative of the change in continuity of the pattern of conductors. The tamper detection area of the pattern of conductors is of sufficient dimensional configuration to enable positioning in close proximity to the object so as to confront more than one surface of object such that alteration of any of the conductors will result in a detectable change in the continuity in the conductor that can be detected by the sensor device.

Still another embodiment of the invention includes a secured structure having a body with exposed surfaces having a pattern of conductors defining a tamper detection area on the exposed surfaces of the structure. At least one sensor device is connected to the pattern of conductors which is capable of detecting a change in continuity of the pattern of conductors and a radio frequency circuit adapted to provide at least one radio frequency signal indicative of a change in the continuity of any of the conductors providing at least one radio frequency signal indicative of the change in continuity of the pattern of conductors wherein the pattern of closely spaced conductors are positioned so as to confront selected exposed surfaces of the body to a sufficient degree so that alteration of the object will require alteration of at lest one of the conductors resulting in a change in the continuity of the conductor that is detectable by the a sensor device.

In a further embodiment of the invention, a tamper detection system is provided for use with an object having exposed surfaces. In accordance with the embodiment, a pattern of conductors extends in a closely spaced configuration, which defines a tamper detection area. At least one sensor device is connected to the pattern of conductors. The at least one sensor device is connected to the pattern of conductors and is capable of detecting a change in the continuity of the pattern of conductors and providing at least one signal indicative of the change in continuity of the pattern of conductors, wherein the tamper detection area of the pattern of conductors is of sufficient dimensional configuration to enable positioning in close proximity to the object so as to confront substantially all of the surfaces of the object such that alteration to the object will cause result in a change in the continuity of the conductors that can be detected by the sensor device.

In certain embodiments of the invention, such as those employing a hollow strand of insulating material filled with electrically conductive powder or fluid as the conductor, the tamper detection system can be provided with the additional benefit of utilizing a conductive powder or fluid which includes a marking substance, such as a dye, colored powder, etc. In doing so, upon breakage in the continuity of the patter of conductors, the powder or fluid would leak from the break and mark the object with the location of the break, as well mark any person or item coming into contact with the area of the break. The marking substance may be a substance, which can only be seen under infrared or ultraviolet light, thereby increasing the security of the object and assisting in identifying the location and persons responsible for the break in the pattern of conductor(s).

The pattern of closely spaced conductors of the invention includes both regularly patterned, woven, non-woven, or random patterns of conductors either provided as a self-supporting web, as a web supported or affixed on or between a flexible substrate(s), or applied randomly to an exposed interior or exterior surface of an object.

Further, in order to protect an object in certain applications, multiple patterns of conductors can be provided on the exposed surfaces of the object. For example, for a cube shaped object, one pattern can be applied circumferentially around the object along one axis of the object and another pattern can be applied around the object along another, transverse axis. Each side of the object may have at least one sensor associated with that side such that if that side were to be tampered with, personnel answering an alarm would know which direction to approach. Additionally, the tamper detection system of the invention can employ multiple types of conductors in a single pattern of conductors, or employ different types of conductors in multiple patterns of conductors on the surfaces of the object. Similarly, a single sensor can be associated with a pattern of conductors that are arranged to define separate detection areas on the substrate with sensor being adapted to be able to discriminate between detection areas.

While an embodiment of the invention includes providing at least one pattern of closely spaced, isolated conductors to an exposed interior or exterior surface of the object to be protected, the invention is viewed as including embedding at least one pattern of closely spaced, isolated conductors into an interior or exterior surface of the object to be protected. This would include both embedding the pattern of closely spaced, conductors into a surface of the object during fabrication of the object, such as during extrusion, molding, casting or laminating to form the object, or embedding the pattern of closely spaced, isolated conductors into a coated interior or exterior surface of the object after formation, such as by applying the pattern of conductors directly to an exposed, coated surface of the object and pressing the pattern of conductors into the coating.

Further, while the preferred embodiments of the invention connects a radio frequency sensing device, e.g., active or passive RFID tags, to the pattern of closely spaced, isolated, conductors in order to sense any change in continuity of the conductors, the invention is not limited to radio frequency sensing devices. That is, other types of sensing and transmission devices can be employed and are viewed as including any device, e.g., optical sensors and acoustic sensor/transponders, which can sense a change in the continuity or integrity of the one or more of the conductors of the pattern of conductors, produce a signal indicative of the change in continuity and transmit the signal to a evaluation device, e.g., remote base station, recording media, reader device, through wired or wireless connection.

The above variations, as well as other embodiments are illustrated in the drawings and discussion to follow.

DETAILED DESCRIPTION OF THE INVENTION

Figure 1:
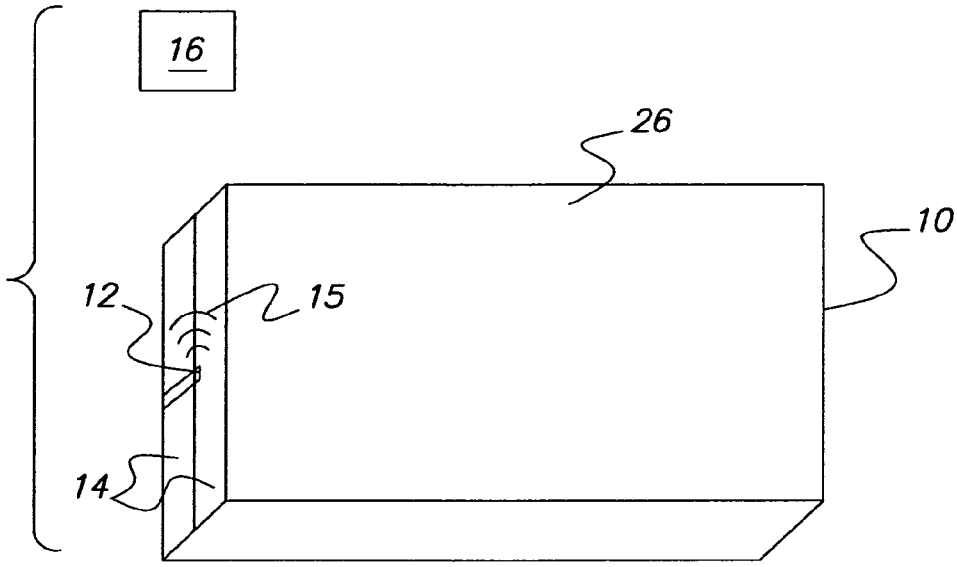
FIG. 1 (PRIOR ART)
FIG. 1 illustrates a conventional cargo seal arrangement.

FIG. 1 shows an illustration of an object to be secured comprising a cargo container 10 in which a seal/monitor 12, of the prior art e.g., RFID, is provided to seal cargo container doors 14 of the cargo container 10 such that any tampering or opening of the cargo container doors 14 of cargo container 10 would cause a change in the characteristics of the seal/monitor 12. A warning of such a change is transmitted by the seal/monitor 12 in the form of a signal 15 such as a radio frequency signal that is to be received by an on-board or remotely located communication device 16 such as a radio frequency communication device, memory (not shown), and/or an alarm system (not shown). Adding protection to container doors 14 of cargo container 10 only leaves the exposed surfaces 26 of cargo container 10 unprotected to tamper detection such that one only has to cut through an exposed surface 26 of cargo container 10 to gain access to and remove the contents of cargo container 10, as often occurs today.

Figure 2:
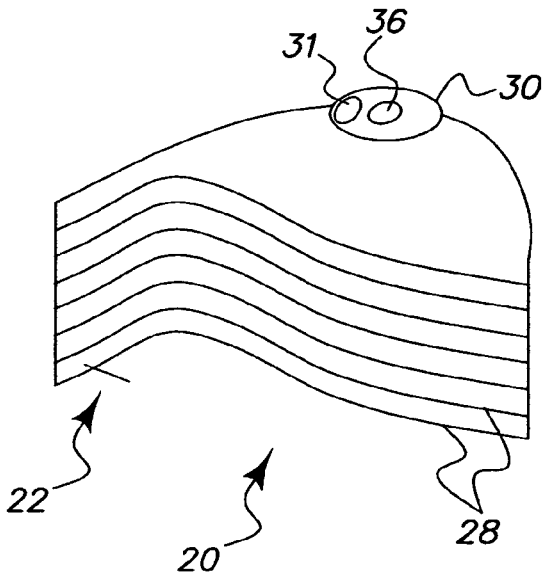
FIG. 2 illustrates a first embodiment of the tamper detection system of the invention for securing cargo from tampering or unauthorized opening.
Figure 7:
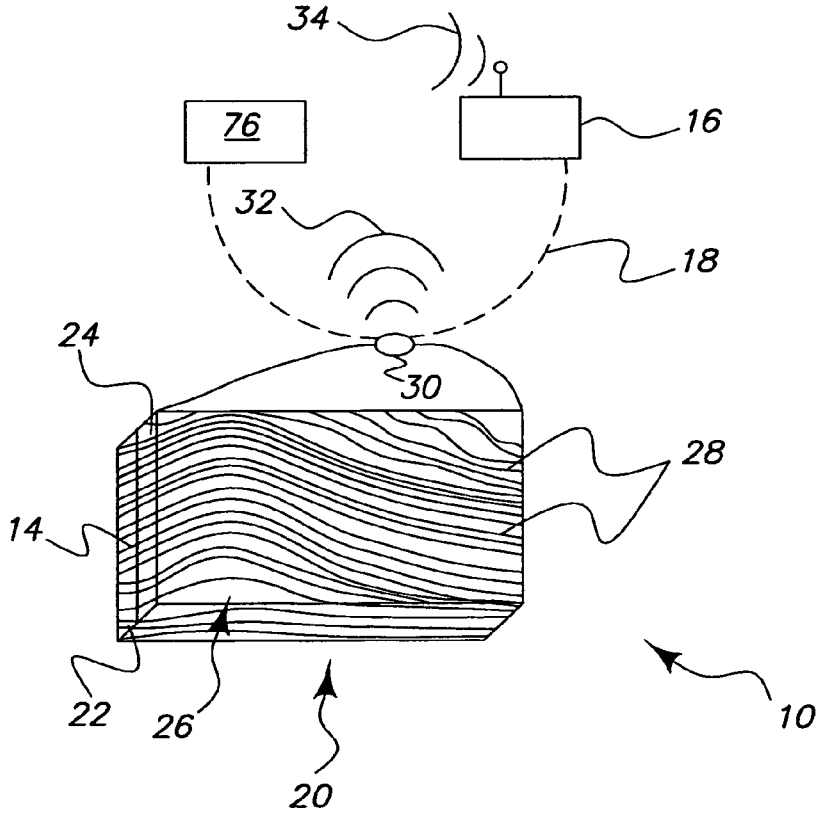
FIG. 7 illustrates a tamper detection system of the invention.

One embodiment of a tamper detection system 20 having a detection device 22 of the invention is shown in FIGS. 2 and 7. As shown in this embodiment, a tamper detection system 20 provides a greater degree of security for the cargo container 10 shown in FIG. 1, by providing a closely spaced, isolated, pattern 24 of conductors 28 which is of sufficient dimension, e.g., width, such that the pattern 24 of conductors 28 can be provided on each exposed surface 26 of cargo container 10; as schematically illustrated in FIG. 7. The pattern 24 of conductors 28 is appropriately arranged such that any attempt to alter or tamper with cargo container 10 or any other object with which the pattern 24 of conductors 28 is associated would result in a change in the continuity of one or more conductors 28 within pattern 24.

Sensor device 30 has a communication circuit 31 such as a radio frequency, optical or other communication circuit that is adapted to transmit at least a signal 32 in a detectable form. Signal 32 is adapted such that it can be used to determine when a change in continuity has occurred. In the embodiment shown, signal 32 is a radio frequency signal that is detectable by a communication device 16 that is adapted to receive such feed as frequency signals. In the embodiment shown in FIG. 7, communication device 16 sends a read signal 34 activating the sensor device 30, and sensor device 30 causes communication circuit 31 to transmit a signal 32 indicative of the state of continuity of the pattern 24 of conductors 28. Alternatively, communication device 16 can be wired directly by an optional wire harness 18 to the sensor device 30, or, in the case of an active radio frequency type of communication circuit 31, sensor circuit 36 actively monitors the continuity of the pattern 24 of conductors 28 and automatically transmits a signal 32 indicative of any change in continuity of the pattern 24 of conductors 28 and/or records information indicative of the change in continuity of the pattern 24 of conductors 28 in a memory.

The continuity of the pattern 24 of conductors 28 is monitored by a sensor circuit 36 that engages conductors 28 and can be adapted, in one embodiment, to provide a test signal to conductors 28, to analyze the response of each conductor and to generate a signal that indicates the current state of conductors 28. In another embodiment, sensor circuit 30 has at least one memory that stores data indicating an initial state of continuity in the pattern 24 of conductors 28, a signal generator adapted to apply a test signal to conductors 28, a comparator for comparing the response of conductors 28 to the test signal against the stored initial state data and for generating a signal that indicates when a change has occurred. The test signal can comprise an electrical, audio, optical or any other signal that can be passed through a conductor 28.

The pattern 24 of conductors 28 can be applied to an internal or external exposed surface 26 of cargo container 10 or both and can include any, electrical, optical or acoustical conductor that can be provided in or on a substrate 38 or that can otherwise be distributed on the surface of cargo container 10. The isolation of the pattern 24 of conductors 28 can be provided by an isolating material on each conductor 28 within a pattern 24, e.g., an insulation coated wire, a hollow strand of insulating material filled with electrically conductive powder or fluid, clad optical fiber or waveguide, or hollow acoustic wave-guide strand. Such isolation can also be provided by a physical separation of the conductors 28 within pattern 24 such as by attaching the pattern 24 of conductors 28 onto an exposed interior or exterior surface of an object or both, by applying the pattern 24 of conductors 28 to an object or as a coating of conductive particles in a binder to a flexible, insolating substrate, or by sandwiching the pattern 24 of conductors 28 between two substrates 38 to isolate the conductors 28 within the pattern 24 of conductors 28. In this later embodiment, the substrate 38 can be an insulating film such as a polymer film that can be applied to exposed interior or exterior surfaces of an object.

In one embodiment, useful for wrapping exposed surfaces 26, a substrate 38 can be a flexible shrink-wrap material, such that, after wrapping an object loosely, the flexible shrink-wrap material is heated to the shrinkage temperature to cause the wrapped substrate to tightly enclose the object. This shrinkage process should not cause a sufficient degree of change in continuity, i.e., alteration or breakage, to generate a signal from the sensing device indicative of tampering such as pilferage, vandalism, or theft.

Figure 3:
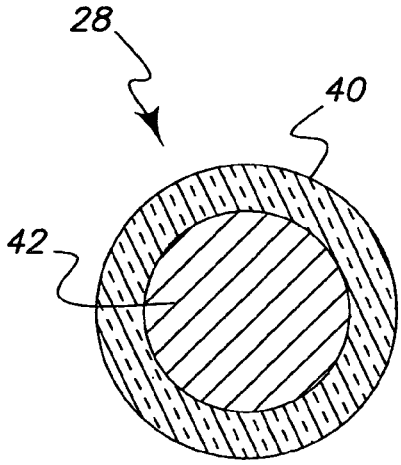
FIG. 3 illustrates one insulation coated conductor of a web of conductors of the invention.

FIGS. 3-6 illustrate several different embodiments of the conductors 28. FIG. 3 shows a cross-section of a conductor 28 composed of insulation 40 coating on a conductor core 42.

FIG. 4A shows, again in cross section, pattern 24 of conductors 28 provided between two substrates 38. The substrates 38 can be autogenously or adhesively laminated to each other and to the conductor 28 to forma a pattern 24 of conductors 28. Substrates 38 can be formed, for example, using thermoplastic or thermoset polymer materials. Such materials can be capable of being formed around the object and can be formed such that the pattern 24 of conductors 28 maintains each conductor 28 in a closely spaced isolated relationship to other conductors 28.

Figure 4A:
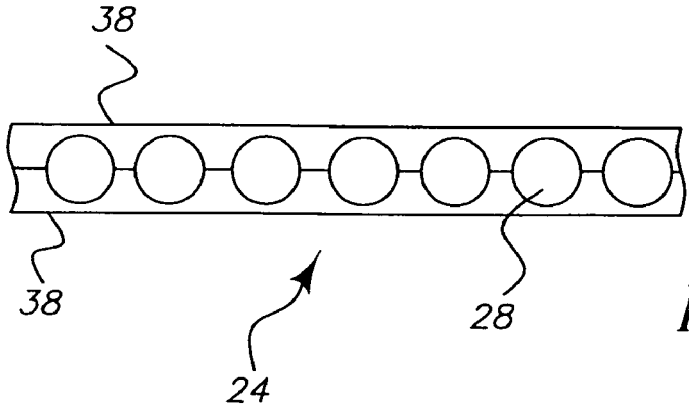
FIG. 4A-4B illustrates in cross section laminate detection device of the invention.
Figure 4B:
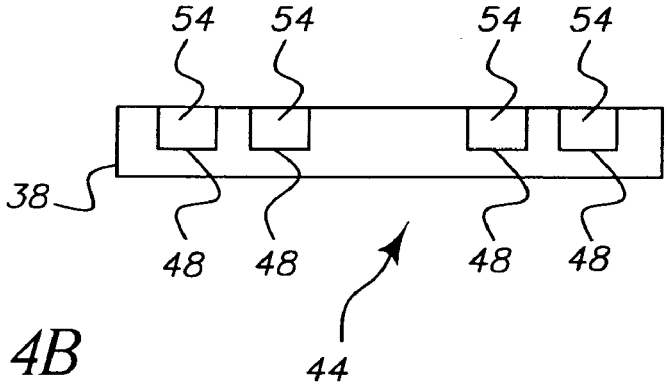

FIG. 4B shows another embodiment of a substrate 38 having pattern 24 of conductors 28 comprising a light guide ribbon structure 44 formed by the steps of roll molding a substrate 38 having a pattern of channels 48 with each channel 48 of substrate 38 forming a light guide 54 extending along each of the channels 48 from the input edge 50 to an output edge (not shown) as is described generally in commonly assigned U.S. patent application Ser. No. 10/439,754, entitled APPARATUS AND METHOD FOR FORMING AN OPTICAL CONVERTER filed by Roger Kerr et al. on May 16, 2003. As is also described therein, light guides 54 are sealed and can comprise hollow reflective channels or can be filled with a light conductive material.

Figure 5A:
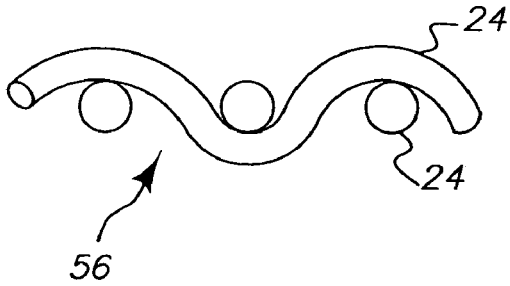
FIGS. 5A-5C illustrate various designs for the conductors employed to form the web of conductors.
Figure 6:
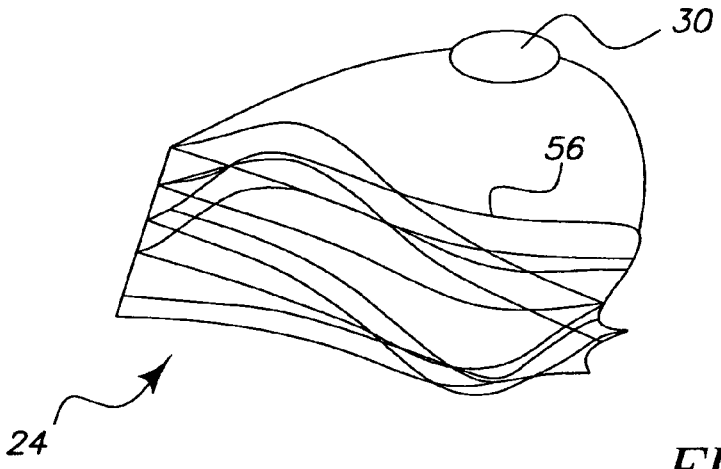
FIG. 6 illustrates a non-woven web of conductors of the invention.

The pattern 24 of conductors 28 can be formed as a non-woven web, such as illustrated in FIGS. 2 and 6, or pattern 24 of conductors 28 can be composed of a woven pattern 24 of conductors 56 such as illustrated in FIG. 5A and could be woven into a fabric or as part of a fabric.

Figure 5B:
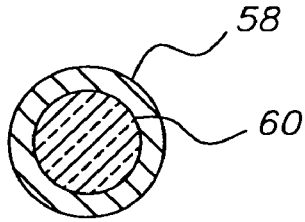
Figure 5C:
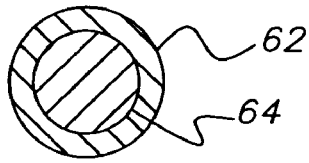

FIG. 5B illustrates, in cross-section, conductors 28 composed of a cladded coating 58 on an optical conductor 60, such as an optical fiber or waveguide; while, FIG. 5C illustrates, in cross section, another embodiment of a conductor 28 composed of hollow tubing 62 filled with a deposited material 64 that is, for example, electrically, optically, or sonically conductive. The deposited material 64 used to fill hollow tubing 62 has characteristics that allow automatic detection of the continuity and in one embodiment can comprise a type of material that will not remain in hollow tubing 62 if the integrity of hollow tubing 62 is compromised. In one embodiment, the deposited material 64 comprises a supply of a conductive material such as metallic particles, dust or other metallic powders. Such an embodiment of deposited material 64 can be suspended in a conductive or non-conductive fluid medium or provided in dry condition. In another embodiment, deposited material 64 can comprise a fluid such as water, alcohol or any other liquid material. In still another embodiment, the deposited material 64 can comprise a material in a gaseous state.

Sensor circuit 36 will be co-designed with conductors 28 to be able to provide an appropriate test signal for any conductor 28 including those having a deposited material 64 therein. Sensor circuit 36 can be adapted to detect when the test signal passes through deposited material.

It will be appreciated that such embodiments provide two distinct advantages: the first is that is nearly impossible to repair conductors 28 of this type. When conductors 28 are a cut, lacerated or opened the deposited material 64 escapes and cannot easily be replaced. Further, the escaping deposited material 64 can provide an indication of tampering that will likely mark any person or tool used in severing conductor 28. In certain embodiments, a marking substance such as a dye can be incorporated in deposited material 64 in conjunction with the particles, fluid or gas.

Figure 8A:
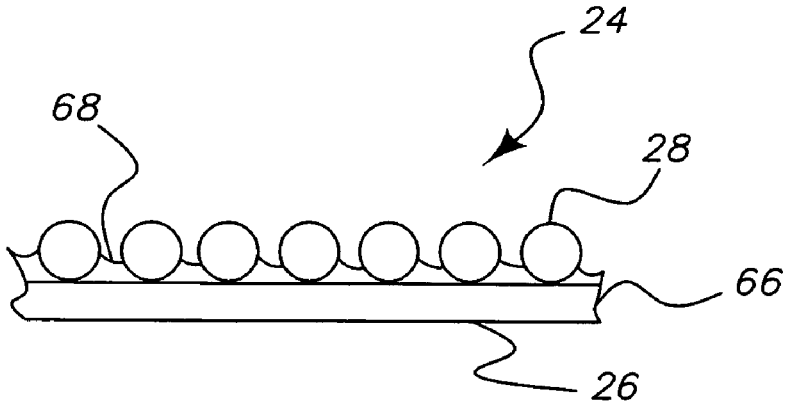
FIGS. 8A, 8B and 8C illustrate, in cross section, a web of conductors coated or embedded on an exposed wall of an object and sandwiched between two walls of an object.
Figure 8B:
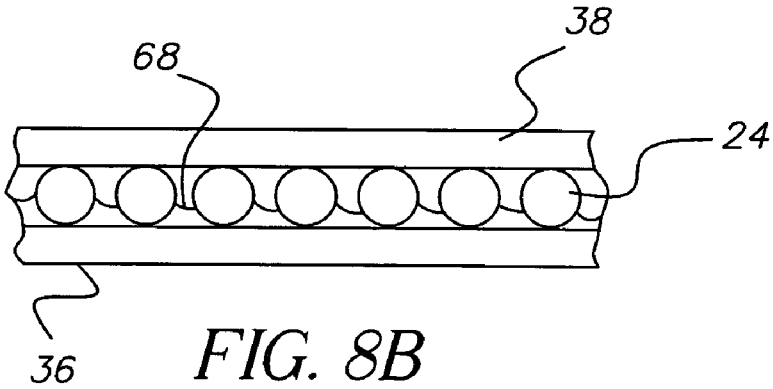
Figure 8C:
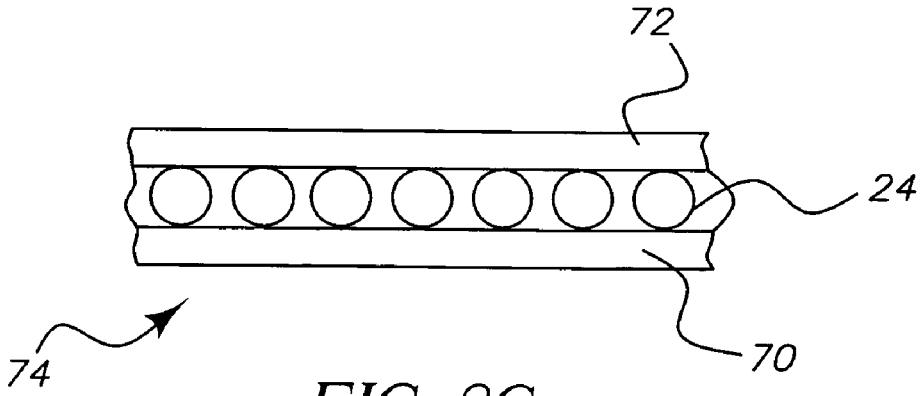

FIGS. 8*a*, 8*b* and 8*c* show cross sectional views of additional embodiments of the invention. Shown in FIG. 8*a* is a version of the detection device 22 of the invention in which the pattern 24 of conductors 28 is attached to an interior or exterior exposed surface 26 of an object 66 by means of a bonding agent 68, i.e. adhesive. FIG. 8B shows a version of the detection device 22 of the invention in which the pattern 24 of conductors 28 mounted between a substrate 38 are attached to an interior or exterior exposed surface 26 of an object 66 by means of a bonding agent 68, i.e., adhesive. FIG. 8C shows a version of the detection device 22 of the invention in which the pattern 24 of conductors 28 can be sandwiched between a interior wall 70 and a exterior wall 72 of a multi-walled object 74 during the manufacture of the multi-walled object 74.

Additionally, it is noted that while illustrated embodiments of the pattern 24 of conductors 28 are shown to be round in cross section, the invention is not limited to the round configuration. For purposes of this invention, the pattern 24 of conductors 28 can by of any cross section, e.g., oblong, rectangular, square, polygonal, or a shape that which facilitates secure attachment to an exposed surface 26 of the object 66 or substrate 38. Further, for purposes of the invention, pattern 24 of conductors 28 are described as being positioned relative to each with sufficient spacing between conductors such that the contents of the object 66 cannot be removed and/or the object 66 itself cannot be contacted without altering and/or breaking the continuity of the pattern 24 of conductors 28 to sufficiently indicate a change in continuity which would be detected by sensor device 30.

The tamper detection system 20 of the invention with reference to FIG. 7, in which the detection device 22 has been shown applied as a pattern 24 of conductors 28 to a cargo container 20, having cargo container doors 14. In the tamper detection system 10 of the embodiment of FIG. 7, after filling the cargo container 10 with items to be shipped, the pattern 24 of conductors 28 is applied to the exterior exposed surfaces 26 and the sensor device 30 is secured thereto. In certain embodiments, this can be accomplished by spraying material to form conductors 28 directly onto container 10. The sensor device 30, shown schematically affixed to the pattern 24 of conductors 28, should be securely positioned such that it would not be easily accessible, e.g., beneath the pattern 24 of conductors 28 adjacent the surface 26 of the container or inside one of the cargo container doors 14. Additionally, more than one pattern 24 of conductors 28 can be applied or wrapped around the cargo container 10 in transverse directions to ensure complete surrounding of the exposed surfaces 26. The multiple patterns 24 of conductors 28, and sensor devices 30, provide inexpensive redundancy in case of damage to one pattern 24 of conductors 28 or sensor devices 30 before or during installation on the object.

Once secured, the tamper detection system 20 would be tested to determine the signal 32 for unaltered/unbroken continuity of the patterns 24 of conductors 28 which can be recorded in local memory, transmitted to a remote base station 76, such as a host computer of a shipping terminal or a hand-held reading computer of a shipper/driver/handler. Thereafter, the cargo container 10 can be stored, loaded for shipment, shipped and unloaded at a receiving terminal and the integrity of the cargo container 10 ensured. This can be done in real time by employing a sensor device 30 having an active radio frequency transponder which records in local memory the continuity status of the cargo container 10 and/or when in the terminal or on route transmits a signal 14 indicative of a change in continuity to a remote base station 76 or hand-held reading computer, and/or activate an alarm. The system can also be used to track changes in continuity after the fact, by employing a passive sensing device, i.e., RFID, which would only be activated when interrogated by a signal 32 from a radio frequency communication device 16.

Further, in order to protect an object in certain applications, multiple patterns 24 of conductors 28 can be provided on the exposed surfaces of the object. For example, for a cube shaped object, one pattern can be applied circumferentially around the object along one axis of the object and another pattern can be applied around the object along another, transverse axis. Each side of the object may have at least one sensor 30 associated with that side such that if that side were to be tampered with the sensor for the side could generate a signal from which it can be determined whether personnel answering an alarm would know which direction to approach. Additionally, the tamper detection system 20 of the invention can employ multiple types of conductors in a single pattern of conductors, or employ different types of conductors in multiple patterns of conductors on the surfaces of the object.

The invention has been described in detail with particular reference to certain preferred embodiments thereof, but it will be understood that variations and modifications can be effected within the spirit and scope of the invention.

PARTS LIST

10 Cargo container
12 Seal/monitor, e.g., RFID
14 Cargo container door
15 Signal
16 Communication device
18 Wire harness
20 Tamper detection system
22 Detection device
24 Pattern of conductors
26 Exposed surface
28 Conductors
30 Sensor device
31 Communication circuit
32 Signal
34 Read signal
36 Sensor circuit
38 Substrate
40 Insulation
42 Conductor core
44 Light guide ribbon structure
48 Channels
54 Light guides
56 Woven pattern of conductors
58 Cladded coating
60 Optical conductor
62 Hollow tubing
64 Deposited conductors
66 Object
68 Bonding agent
70 Interior wall
72 Exterior wall
74 Multi walled object
76 Remote base station

The invention claimed is:

1. A detection device for use with an object having at least one surface, the device comprising:

a flexible web substrate including a pattern of conductors extending in spaced isolated configuration on the substrate to define a detection area upon the substrate; and at least one sensor device connected to the pattern of conductors, each sensor device being capable of detecting a change in continuity of at least one of the conductors and providing at least one signal indicative of a change in continuity of any of the conductors, wherein the tamper detection area of the pattern of conductors is of sufficient dimensional configuration to enable positioning in close proximity to the object so as to confront each surface of the object.

2. The detection device of claim 1, wherein each conductor is an electrical conductor and the pattern of conductors conduct electrical current such that the detectable change in continuity results from a detectable change in the current passing through the conductors.

3. The detection device of claim 1, wherein each conductor is an optical waveguide and the conductors conduct light such that the detectable change in continuity results from a detectable change in the light passing through the conductors.

4. The detection device of claim 1, wherein the pattern of conductors is composed of individual conductors some of which conduct electric current and others of which conduct light such that the detectable change in continuity results from a detectable change in either the current or the light passing through the conductors.

5. The detection device of claim 1, wherein each conductor is a hollow member filled with an electrically conducting powder, wherein upon breakage of the conductor at least a portion of the power escapes from the hollow member so that repair of the conductor requires replacement of the powder and, a detectable change in continuity results from a detectable change in the current passing through the conductor.

6. The detection device of claim 1, wherein each conductor is a hollow path having a fluid therein, wherein upon breakage of the conductor at least a portion of the fluid escapes from the path so that repair of the conductor requires replacement of the fluid and a detectable change in continuity results from the absence of fluid in the path.

7. The detection device of claim 1, wherein the conductors include at least one of hollow members filled with an electrically conducting powder and a marker substance and hollow members filled with a fluid and a marker substance, wherein upon breakage of any conductor a detectable change in continuity results from a detectable change in either the current or light passing through the conductor and the marking substance provides an indication of the breakage.

8. The detection device of claim 1, wherein the object has exterior walls and the pattern of conductors is applied to each exterior wall of the object.

9. The detection device of claim 1, wherein the object has interior walls and flexible web substrate is applied to the interior walls of the object.

10. The detection device of claim 1, wherein the object has exterior walls and interior walls and the pattern of conductors is applied to each exterior and interior wall surface of the object.

11. The detection device of claim 1, wherein the each conductor is composed of a deposited coating from a solution of optically, electrically, or sonically conductive particles in a binder.

12. The detection device of claim 1, wherein the flexible substrate comprises the pattern of conductors sandwiched between two substrates.

13. The detection device of claim 12, wherein the pattern of conductors is bonded to a least one of the two substrates.

14. The detection device of claim 1, wherein substrate is a polymer film.

15. The detection device of claim 14, wherein the polymer film is a heat-shrinkable film.

16. The detection device of claim 1, wherein the at least one sensor device is a radio frequency device selected from the group consisting of a passive radio frequency transponder or an active radio frequency transponder including a power source.

17. The detection device of claim 1, wherein the pattern of conductors comprise a non-woven pattern of conductors.

18. The detection device of claim 1, wherein the flexible web substrate comprises fabric of conductors woven together.

19. A tamper detection system for use with an object having surfaces, the system comprising:

a flexible web substrate including a pattern of conductors formed as a pattern of channels in the substrate and extending in closely spaced configuration to define a tamper detection area upon the substrate such that alteration of any of the conductors will result in a detectable change in the continuity in the conductor; and at least one sensor device connected to the pattern of conductors said sensor device being capable of detecting a change in the continuity of the pattern of conductors and having a radio frequency circuit providing at least one radio frequency signal indicative of the change in continuity of any of the conductors, wherein the tamper detection area of the pattern of conductors is of sufficient dimensional configuration to enable positioning in close proximity to the object so as to confront more than one surface of the object.

20. The tamper detection system of claim 19, further comprising a radio frequency communication device capable of receiving from the at least one sensor device at least one the radio frequency signal indicative of the detected change in the continuity of the pattern of conductors.

21. The tamper detection system of claim 19, wherein at least one of the conductors contains a marker that is released when the conductor is altered.

22. The tamper detection system of claim 19, wherein the pattern of conductors is applied in a pattern onto the substrate.

23. The tamper detection system of claim 19, wherein the each conductor is a unitary electrical conductor and the detection in the change in continuity is a detection of the change in current passing through any of the conductors.

24. The tamper detection system of claim 19, wherein each conductor is composed of a deposited coating from a solution of optically, electrically, or sonically conductive particles in a binder, said coating being deposited in the channels to form the conductors.

25. The tamper detection system of claim 19, wherein the substrate comprises the pattern of conductors positioned between two insulating substrates.

26. The tamper detection system of claim 19, wherein the substrate is a polymer film.

27. The tamper detection system of claim 26, wherein the polymer film is a heat-shrinkable film.

28. The tamper detection system of claim 25, wherein the pattern of conductors are bonded to a least one of the two insulating substrates.

29. The tamper detection system of claim 19, wherein the radio frequency transmitter is a passive radio frequency transponder.

30. The tamper detection system of claim 19, wherein the radio frequency transmitter is an active radio frequency transponder which includes a battery.

31. A secured structure comprising:

a body having exposed surfaces;

a pattern of conductors defining a tamper detection area on the exposed surfaces of the body; and at least one sensor device connected to the pattern of conductors which is capable of detecting a change in continuity of the pattern of conductors, said sensor device having a radio frequency circuit adapted to provide at least one radio frequency signal indicative of a change in the continuity any of the conductors, wherein the pattern of conductors are channels formed in the exposed surfaces of the body so as to confront at least part of each exposed surface of the body such that alteration of the object will require alteration of at least one of the conductors resulting in a change in the continuity of the conductors that is detectable by sensor device.

32. The secured structure of claim 31, wherein the channels extend in closely spaced configuration in the exterior surfaces to define the tamper detection area.

33. The secured structure of claim 31, wherein the channels are arranged in the exposed surfaces of the body such that the tamper detection area covers substantially all surfaces of the body.

34. The secured structure of claim 31, wherein the pattern of conductors comprises electrically, optically, or sonically conductive material that is coated in the channels.

35. The secured structure of claim 31, wherein the pattern of conductors is applied in a non-uniform pattern onto exposed surfaces of the body.

36. The secured structure of claim 31, wherein the pattern of conductors is formed in repetitive patterns in the exposed surfaces of the body.

37. The secured structure of claim 31, wherein the each conductor is composed of an electrically conductive solution of conductive particles in a binder and deposited in the channels such that the detection in the change in continuity is a detection of the change in current passing through the conductors.

38. The secured structure of claim 31, wherein the, flexible substrate comprises the pattern of conductors sandwiched between two, flexible substrates.

39. The secured structure of claim 31, wherein, substrate is a polymer film.

40. The secured structure of claim 39, wherein the polymer film is a heat-shrinkable film and the substrate is wrapped onto the cargo, container or product and heated to shrink the wrapping onto the cargo container or product.

41. The secured structure of claim 31, wherein the pattern of conductors are bonded to a least one of the two, insulating substrates.

42. The secured structure of claim 31, wherein the radio frequency circuit is a passive radio frequency transponder.

43. The secured structure of claim 31, wherein the radio frequency circuit is an active radio frequency transponder which includes a battery.

44. The secured structure of claim 31, wherein the pattern of conductors is coated on interior surfaces of a cavity within the structure.

45. The secured structure of claim 31, wherein the pattern of conductors is coated on all interior surfaces of a cavity within the structure.

46. The secured structure of claim 31, wherein at least one of the conductors contains a marker that is released when the conductor is altered.

47. The secured structure of claim 31, wherein the pattern of conductors is applied in repetitive patterns onto the, substrate.

48. The secured structure of claim 31, wherein the each conductor is composed of an electrically conductive deposited coating from a solution of conductive particles in a binder and wherein the detection in the change in continuity is a detection of the change in current passing through the conductors, said coating being deposited in the channels.

49. The secured structure of claim 31, wherein a plurality of distinct patterns of conductors are formed on the body.

50. The secured structure of claim 31, wherein a plurality of substrates having a pattern of conductors formed thereon are placed on the body.

51. A tamper detection system for use with an object having surfaces comprising:

a flexible support web having a pattern of conductors extending in a spaced configuration which defines a tamper detection area; and at least one sensor device connected to the pattern of conductors which is capable of detecting a change in continuity of the pattern of conductors and providing at least one signal indicative of the change in continuity of the pattern of conductors, wherein the tamper detection area of the pattern of conductors is of sufficient dimensional configuration to enable positioning in close proximity to the object so as to confront substantially all of the surfaces of the object such that any alteration of the object will cause alteration of the pattern of conductors resulting in a change in the continuity of the conductors that can be detected by the sensor device and a radio frequency reader capable of receiving the at least one signal from the at least one sensor device.

52. The tamper detection system of claim 51, wherein the pattern of conductors comprises a non-woven pattern of conductors.

53. The tamper detection system of claim 51, wherein the pattern of conductors comprises the pattern of conductors between two substrates.

54. The tamper detection system of claim 53, wherein the pattern of conductors are bonded to a least one of the two substrates.

55. The tamper detection system of claim 51, wherein, substrate is a polymer film.

56. The tamper detection system of claim 55, wherein the polymer film is a heat-shrinkable film.

57. The tamper detection system of claim 51, wherein the radio frequency device is a passive radio frequency transponder.

58. The tamper detection system of claim 51, wherein the sensor device has a memory and wherein the sensor device stores, in the memory, data from which a change in the continuity of at least one of the conductors can be determined.

59. The tamper detection system of claim 51, wherein the each conductor is a unitary insulation coated wire and the pattern of conductors is formed in a pattern of conductors such that a change in continuity can be detected by a change in current passing through the pattern of conductors.

60. The tamper detection system of claim 51, wherein each conductor is an electrical conductor and the pattern of conductors conduct electrical current such that the detectable change in continuity results from a detectable change in the current passing through the conductors.

61. The tamper detection system of claim 51, wherein each conductor is an optical waveguide formed in a channel within the flexible support and the pattern of conductors conduct light such that the detectable change in the continuity results from a detectable change in the light passing through the conductors.

62. The tamper detection system of claim 51, wherein the pattern of conductors are composed of individual conductors some of which conduct electric current and others of which conduct light such that the detectable change in the continuity results from a detectable change in either the current or the light passing through the conductors.

63. The tamper detection system of claim 51, wherein each conductor is a hollow member filled with an electrically conducting powder and a marker substance, wherein upon breakage of the conductor, conducting power, and the marker substance are released causing a detectable change in continuity that is detectable from a detectable change in the current passing through the conductor.

64. The tamper detection system of claim 51, wherein each conductor is a hollow path having a fluid therein, wherein upon breakage of the conductor a detectable change in continuity results from a detected absence of fluid in the path.

65. The tamper detection system of claim 51, wherein some conductors are hollow members filled with an electrically conducting powder and other conductors are hollow members filled with a light transmitting fluid and a marker substance, wherein upon breakage of any of the conductors, detectable change of the signal results from a detectable change in either the current or light passing through the conductor.

66. The tamper detection system of claim 51, wherein some conductors are hollow members filled with an electrically conducting powder and a marker substance and other conductors are hollow optical waveguides filled with a light transmitting fluid and a marker substance, wherein upon breakage of the conductor a detectable change of the signal results from a detectable change in either the current or light passing through the conductor and the marking substance provides an indication of the breakage location on the object.

67. The tamper detection system of claim 51, wherein the object has more than one surface and wherein the sensor device and substrate are positioned on one surface and wherein at least one additional sensor device having a substrate with a pattern of conductors is positioned on another surface, with the sensors being adapted to provide a signal from which it can be determined which side of the object has conductors that have been altered.

68. The tamper detection system of claim 51, wherein the support has a pattern of conductors arranged into separate tamper detection areas, wherein the sensor is adapted to be able to test the continuity of the pattern of conductors so that the sensor device can discriminate between alteration of conductors in one tamper detection area from alteration of conductors in other tamper detection areas and can generate signal from which it can be determined which tamper detection area has conductors that have been altered.

69. A tamper detection system for use with an object having surfaces composing:

a pattern of conductors extending in a spaced configuration which defines a tamper detection area; and at least one sensor device connected to the pattern of conductors which is capable of detecting a change in continuity of the pattern of conductors and providing at least one signal indicative of the change in continuity of the pattern of conductors, wherein the tamper detection area of the pattern of conductors is of sufficient dimensional configuration to enable positioning in close proximity to the object so as to confront substantially all of the surfaces of the object such that any alteration of the object will cause alteration of the pattern of conductors resulting in a change in the continuity of the conductors that can be detected by the sensor device; and wherein the pattern of conductors are woven together to form a web comprising a fabric of the conductors.

70. A tamper detection system for use with an object having surfaces comprising:

a web support bearing a pattern of conductors extending in a spaced configuration which defines a tamper detection area; and at least one sensor device connected to the pattern of conductors which is capable of detecting a change in continuity of the pattern of conductors and providing at least one signal indicative of the change in continuity of the pattern of conductors, wherein the tamper detection area of the pattern of conductors is of sufficient dimensional configuration to enable positioning in close proximity to the object so as to confront substantially all of the surfaces of the object such that any alteration of the object will cause alteration of the pattern of conductors resulting in a change in the continuity of the conductors that can be detected by the sensor device further comprising a radio frequency reader capable of receiving from the at least one sensor device at least one the radio frequency signal indicative of the change in continuity of the pattern of conductors, wherein the each conductor is composed of a sonically conductive, deposited coating from a solution of conductive particles in a binder such that the detection in the change in continuity is a detection of the change in sound passing through the conductors.

* * * * *

UNITED STATES PATENT AND TRADEMARK OFFICE

CERTIFICATE OF CORRECTION

PATENT NO. : 7,274,289 B2
APPLICATION NO. : 10/854880
DATED : September 25, 2007
INVENTOR(S) : Roger S. Kerr et al.

It is certified that error appears in the above-identified patent and that said Letters Patent is hereby corrected as shown below:

| | |
|---|---|
| Column 15, Line 9 | In Claim 65, after "conductors," insert -- a -- |
| Column 15, Line 41 | In Claim 69, delete "composing:" and insert -- comprising: -- |

Signed and Sealed this

Third Day of June, 2008

JON W. DUDAS
*Director of the United States Patent and Trademark Office*